US008293078B2

(12) United States Patent
Despinasse et al.

(10) Patent No.: US 8,293,078 B2
(45) Date of Patent: Oct. 23, 2012

(54) DEVICE AND METHOD FOR SHORT-CIRCUITING ONE OR MORE CELLS IN AN ARRANGEMENT OF ELECTROLYSIS CELLS INTENDED FOR THE PRODUCTION OF ALUMINIUM

(75) Inventors: Serge Despinasse, Fontcouverte-la Toussuire (FR); Yves Rochet, Saint Jean de Maurienne (FR); Olivier Martin, Hermillon (FR)

(73) Assignee: Rio Tinto Alcan International Limited, Montreal (CA)

( * ) Notice: Subject to any disclaimer, the term of this patent is extended or adjusted under 35 U.S.C. 154(b) by 278 days.

(21) Appl. No.: 12/863,950

(22) PCT Filed: Jan. 7, 2009

(86) PCT No.: PCT/EP2009/000031
§ 371 (c)(1),
(2), (4) Date: Jul. 21, 2010

(87) PCT Pub. No.: WO2009/092513
PCT Pub. Date: Jul. 30, 2009

(65) Prior Publication Data

US 2010/0294635 A1 Nov. 25, 2010

(30) Foreign Application Priority Data

Jan. 21, 2008 (EP) ..... 08356012

(51) Int. Cl.

| | |
|---|---|
| ***C25C 7/00*** | (2006.01) |
| ***C25C 3/06*** | (2006.01) |
| ***C25C 3/16*** | (2006.01) |
| ***H01R 24/86*** | (2011.01) |
| ***H01R 101/00*** | (2006.01) |

(52) U.S. Cl. ..... 204/230.3; 205/372; 205/374; 204/244; 204/230.2; 204/230.5; 204/279; 439/775; 439/786; 439/796

(58) Field of Classification Search ..... 205/372–396; 204/244
See application file for complete search history.

(56) References Cited

U.S. PATENT DOCUMENTS 3,640,800 A * 2/1972 Johnson ..... 205/374
(Continued)

FOREIGN PATENT DOCUMENTS

CN 2835264 Y 11/2006
(Continued)

OTHER PUBLICATIONS

International Search Report dated May 8, 2009 (PCT/EP2009/000031); ISA/EP.

*Primary Examiner* — Harry D Wilkins, III
(74) *Attorney, Agent, or Firm* — Banner & Witcoff, Ltd.

(57) ABSTRACT

The invention relates to a device (50) and a method for short-circuiting a specified electrolysis in a row of electrolysis cells intended for the production of aluminum. This device includes a bridging member (60) including at least two opposite contact arms and at least one bridging conductor electrically that electrically connects the contact arms. The contact arms are shaped like a wedge. The device further includes a clasping member (70) including a frame and a least two opposite thrust members. The clasping member (70) is fit to embrace the bridging member (60) so that each thrust member bears on each contact arm and so that, upon moving the contact arms with respect to the clasping member, each thrust member urges the corresponding contact arm towards the conductors (201, 202) inserted between the contact arms, so as to create and secure a short-circuit. The invention makes it possible to short-circuit electrolysis cells with increased amperages.

18 Claims, 7 Drawing Sheets

U.S. PATENT DOCUMENTS

| | | | | |
|---|---|---|---|---|
| 3,660,256 | A * | 5/1972 | Lippitt et al. | 205/336 |
| 2007/0034520 | A1* | 2/2007 | Ritter et al. | 205/336 |
| 2007/0205099 | A1* | 9/2007 | Le Hervet et al. | 204/230.5 |
| 2008/0029403 | A1* | 2/2008 | Ramaswamy et al. | 205/230 |
| 2010/0155259 | A1* | 6/2010 | Ramaswamy et al. | 205/372 |

FOREIGN PATENT DOCUMENTS

| | | |
|---|---|---|
| DE | 1077436 B | 3/1960 |
| FR | 2491091 A | 4/1982 |

* cited by examiner

DEVICE AND METHOD FOR SHORT-CIRCUITING ONE OR MORE CELLS IN AN ARRANGEMENT OF ELECTROLYSIS CELLS INTENDED FOR THE PRODUCTION OF ALUMINIUM

The present application is a U.S. National Phase filing of International Application No. PCT/EP2009/000031, filed Jan. 7, 2009, which claims priority to European Patent Application No. EP 08356012.8, filed Jan. 21, 2008, both of which the present application claims priority to and the benefit of, and both of which are incorporated by reference herein in their entireties.

FIELD OF THE INVENTION

The invention relates to the production of aluminium by means of igneous electrolysis, i.e. by means of electrolysis of alumina dissolved in a molten salt bath according to the Hall-Héroult process. The invention particularly relates to the short-circuiting of one or more cells in a series of electrolysis cells designed for the production of aluminium.

STATE OF THE ART

According to the Hall-Héroult process that is widely used industrially aluminium is produced by electrolytic reduction of alumina in electrolysis cells.

A plant for the production of aluminium comprises a plurality of electrolysis cells that are arranged in rows. The cells of a row are electrically connected in series by means of interconnecting conductor arrangements.

Several arrangements have been devised for the interconnecting conductors, such as the one described in U.S. Pat. Nos. 4,200,513, 4,592,821 and 4,713,161 in the name of Aluminium Pechiney.

U.S. Pat. No. 6,409,894 in the name of Aluminium Pechiney describes possible arrangements of plants designed for the production of aluminium using electrolysis cells.

The electrolysis cells of a plant usually need to be refurbished or repaired from time to time. In particular, the lining and cathode arrangement of the pot of the cells need to be changed after several years of use. For economical and technical reasons it is preferable not to interrupt the electrical current in the series to which a cell pertains during its refurbishment or repair. For that purpose it is known from French patent application No. 2 550 553 (corresponding to Australian patent application No. 31748/84) in the name of Aluminium Pechiney to short-circuit a cell so that the electrical current can bypass the same during the refurbishment or repair operations.

A widely used method for short-circuiting an electrolysis cell comprises intercalating metallic blocks between specific interconnecting conductors, as indicated in U.S. Pat. No. 4,713,161.

Since the short-circuiting metallic blocks have to carry the full intensity of the electrical current of a series of cells these blocks must withstand the high intensities that are used in modern cells. Typically, nowadays, cell intensities exceed 200 kA and 300 kA, depending on the type of technology.

The present trend in the aluminium industry is to boost the current intensities of existing cell arrangements. For example, in plants using the Alcan technologies, cells that were initially designed for current intensities of 180 kA have often been boosted to work at intensities of more than 240 kA and, similarly, cells that were initially designed for current intensities of 280 kA have often been boosted to work at intensities of more than 340 kA.

One consequence of this trend has been that the known means and methods for short-circuiting electrolysis cells are often no longer satisfactory. In particular, at high intensities, the short-circuiting blocks introduce high voltage drops in a series of cells and could even melt if the intensity were further increased.

Therefore, the applicant searched economically and technically satisfactory alternative solutions to short-circuit electrolysis cells.

DESCRIPTION OF THE INVENTION

The invention relates to a device for short-circuiting at least one specified cell in an arrangement of electrolysis cells intended for the production of aluminium by igneous electrolysis, said arrangement including a plurality of electrolysis cells that are electrically connected in series, wherein said device includes:

a bridging member including a first contact arm having a first contact surface and a first outer surface, a second contact arm having a second contact surface and a second outer surface, and at least one bridging conductor that electrically connects said first and second contact arms, said first contact surface being substantially opposite and inclined with respect to said first outer surface, said second contact surface being substantially opposite and inclined with respect to said second outer surface, said bridging member forming an opening between said contact arms, and a clasping member including a frame, a first thrust member and a second thrust member, said clasping member being fit to embrace said bridging member so that said first outer surface bears on said first thrust member while said second outer surface bears on said second thrust member and so that, upon moving said contact arms with respect to said clasping member, said first thrust member urges said first contact arm towards said second contact arm while said second thrust member urges said second contact arm towards said first contact arm.

The invention further relates to a method of short-circuiting at least one specified cell in an arrangement of electrolysis cells intended for the production of aluminium by igneous electrolysis, said arrangement including a plurality of electrolysis cells, and a network of electrical conductors, said specified cell including a pot and at least one anode beam for connecting at least one anode thereto, said pot including a cathode arrangement and at least one collector bar connected to said cathode arrangement and protruding from said pot, said network including at least a first conductor portion that is electrically connected to said at least one anode beam and has a first internal surface and a first external surface substantially opposite said first internal surface, and at least a second conductor portion that is electrically connected to said at least one collector bar and has a second internal surface and a second external surface substantially opposite said second internal surface, said first and second conductor portions being so arranged that said first internal surface substantially faces said second internal surface, wherein said method includes:

providing at least one short-circuiting device according to the invention, placing said device so that said first and second conductor portions fit in said opening and so that said first contact surface overlaps said first external surface while said second contact surface overlaps said second external surface, and moving said contact arms of said bridging member relative to said clasping member so that said first thrust member urges said first contact arm towards said second contact arm while said second thrust member urges said second contact arm towards said first contact arm, thereby creating and securing a short-circuit between said first and second conductor portions.

The applicant noted that said device and method make it possible to efficiently short-circuit electrolysis cells and reopen said short-circuit when needed. The handling of said device has been found to be easy.

The invention is further described hereinafter using the appended figures.

Figure 1:
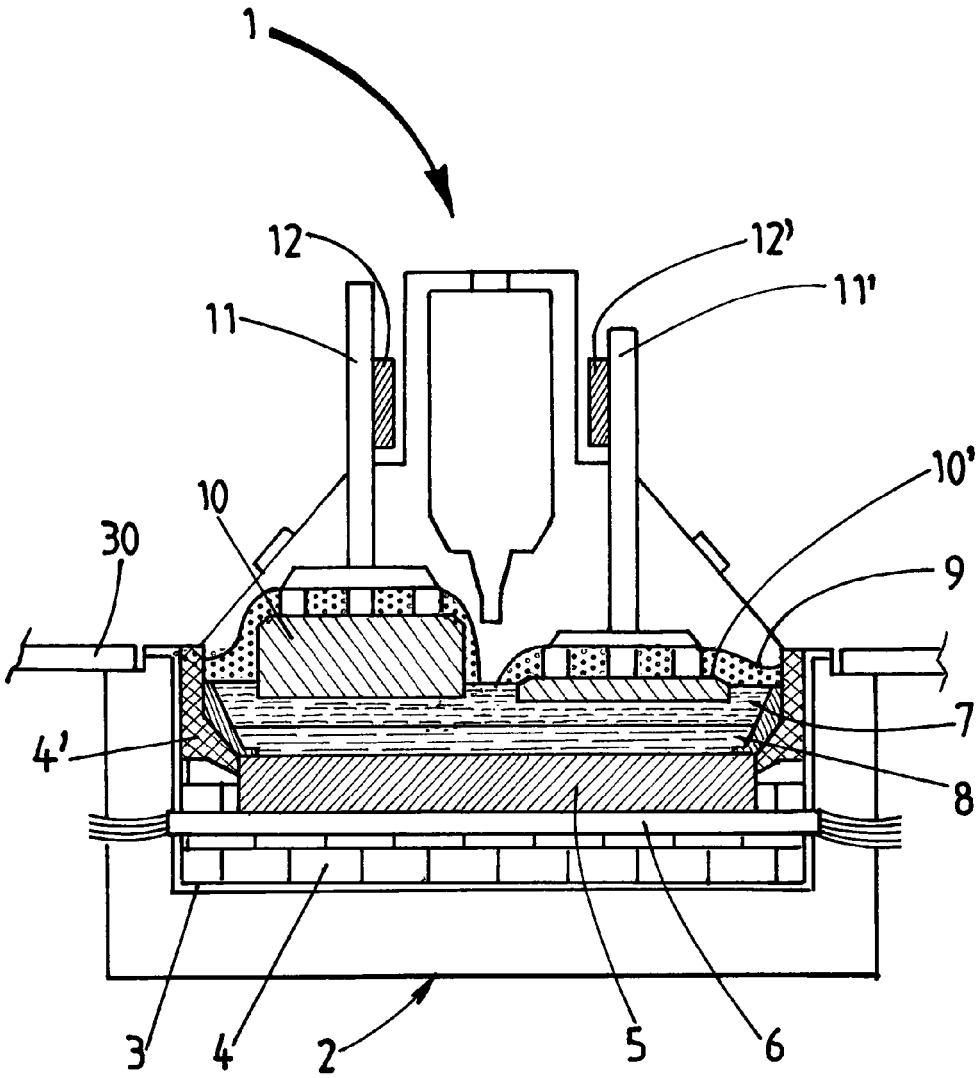
FIG. 1 illustrates a transverse cross section view of a typical electrolysis cell intended for the production of aluminium.

As illustrated in FIG. 1, an electrolysis cell (1) comprises a pot (2) that is usually located below a floor (30) common to several cells and comprises a steel shell (3) lined with refractory material (4, 4'). Said pot (2) is generally rectangular, when viewed from above.

Said pot (2) further includes a cathode arrangement (5) and a plurality of collector bars (6) made of an electrically conducting material, such as steel, or a combination of conducting members, such as steel and copper members. Said cathode arrangement (5) typically includes a plurality of carbonaceous cathode blocs. Said collector bars (6) protrude from said pot (2), and more specifically from said shell (3), for electrical connection thereto.

As further illustrated in FIG. 1, an electrolysis cell (1) also includes a plurality of anodes (10, 10'), which are typically made of a carbonaceous material, usually a prebaked carbonaceous material.

In use, the pot (2) contains an electrolytic bath (7) and a pad of liquid aluminium (8). Said electrolytic bath (7) typically includes fluorides of sodium and aluminium, typically non stoichiometric cryolite, and possibly additives, such as calcium fluoride. In operation, said electrolytic bath (7) further contains alumina dissolved therein. When a cell is being operated, the anodes (10, 10') are partially immersed in said electrolytic bath (7) and are protected from oxidation by a protecting layer (9) that is mostly comprised of alumina and crushed bath.

Figure 2:
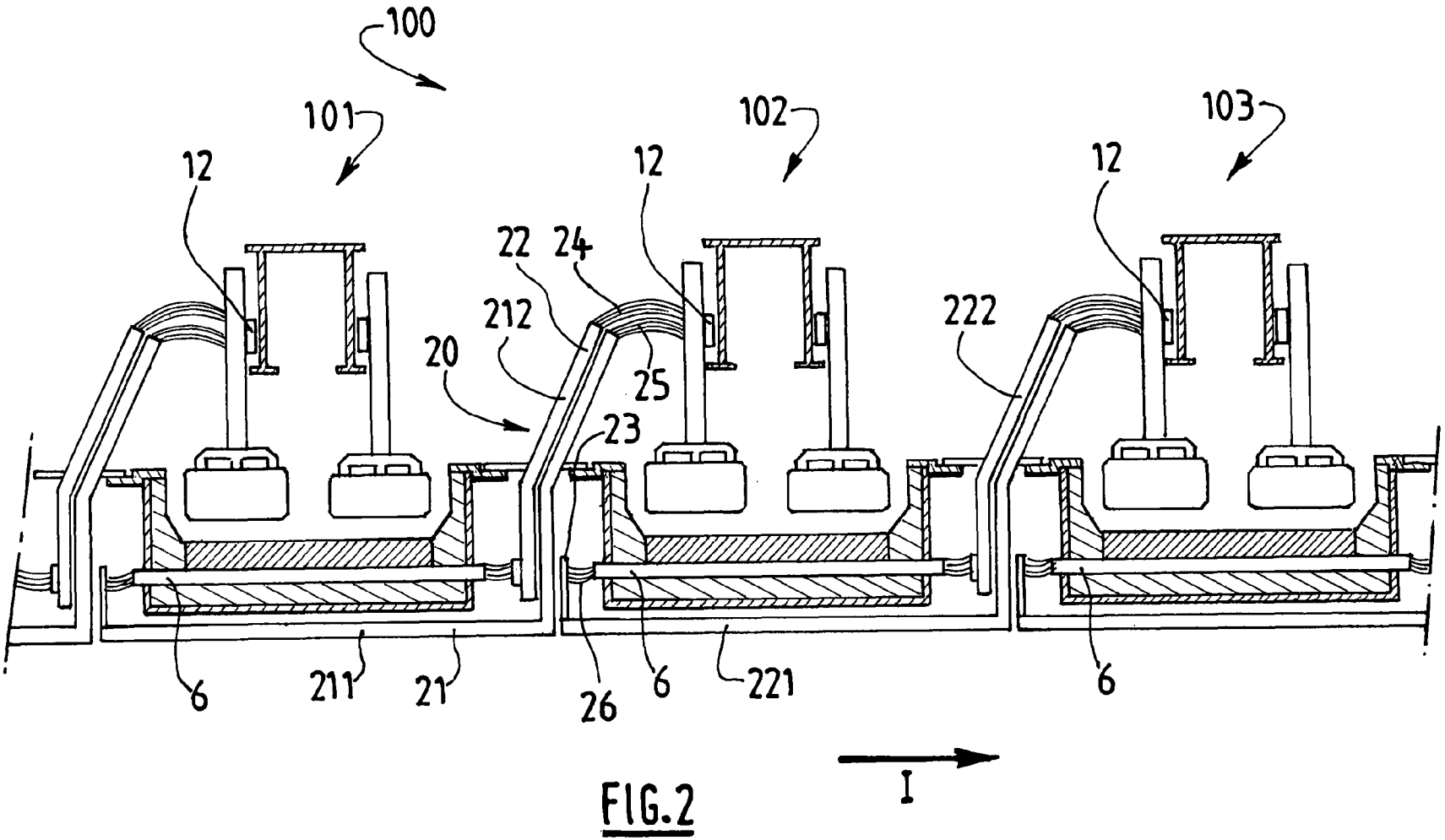
FIG. 2 illustrates, in a simplified manner and in a transverse cross-sectional view, three successive electrolysis cells in a cell row.

As illustrated in FIG. 2, a typical arrangement (100) of electrolysis cells in a plant includes a plurality of cells (101, 102, 103) that are disposed so as to form at least one row and are electrically connected in series by interconnecting conductors (21, 22, 23, 24, 25, 26) that form a network (20). For the sake of clarity, elements of the cells, such as the electrolytic bath and the pad of liquid aluminium, have been omitted from the drawing in FIG. 2.

Said interconnecting conductors (21, 22, 23, 24, 25, 26) typically include rigid conductors (21, 22, 23) and flexible conductors (24, 25, 26) and are usually made of aluminium or aluminium alloys. Said rigid conductors typically include busbars (23). Said flexible conductors (24, 25, 26) are typically made of foils. Said interconnecting conductors (21, 22, 23, 24, 25, 26) form branches (211, 212, 221, 222). For the sake of simplicity, FIG. 2 illustrates only two branches of said network for each electrolysis cell.

The anodes (10, 10') are connected to said external electrical conductors (21 to 26) using anode stems (11, 11') sealed in the anodes and secured to common conductors (12, 12') called anode beams using removable connectors (not illustrated). Said cathode arrangement (5) is connected to said external electrical conductors (21 to 26) using said collector bars (6).

Most plants have a large number of electrolysis cells (typically more than a hundred) arranged in lines, in buildings called electrolysis halls or potrooms. A plant usually includes two or more parallel lines that each comprise one or more rows and are electrically connected together by end conductors so as to form one or more series of cells.

The cells of a row can be oriented either longitudinally (i.e. such that their longer axis is parallel with the main line axis), or transversally (i.e. such that their longer axis is perpendicular to the main line axis). FIG. 2 corresponds to the latter case. The invention is particularly advantageous for electrolysis cells arranged transversally.

In operation, an electrical current flows from one cell to the next in cascade fashion. Arrow I in FIG. 2 illustrates the usual direction of the current I in a row of electrolysis cells.

When a cell of a row needs to be refurbished or repaired, said cell is first short-circuited, usually by short-circuiting at least a first conductor connected to an anode beam of said cell and at least a second conductor connected to a collector bar of said cell. For example, if cell 102 of FIG. 2 needs to be bypassed for tending, a short-circuit could be made by connecting together a conductor branch 211 stemming from the preceding cell 101 and a conductor branch 221 leading to the following cell 103. An electrical current circulating in said row then bypasses said cell.

Figure 3:
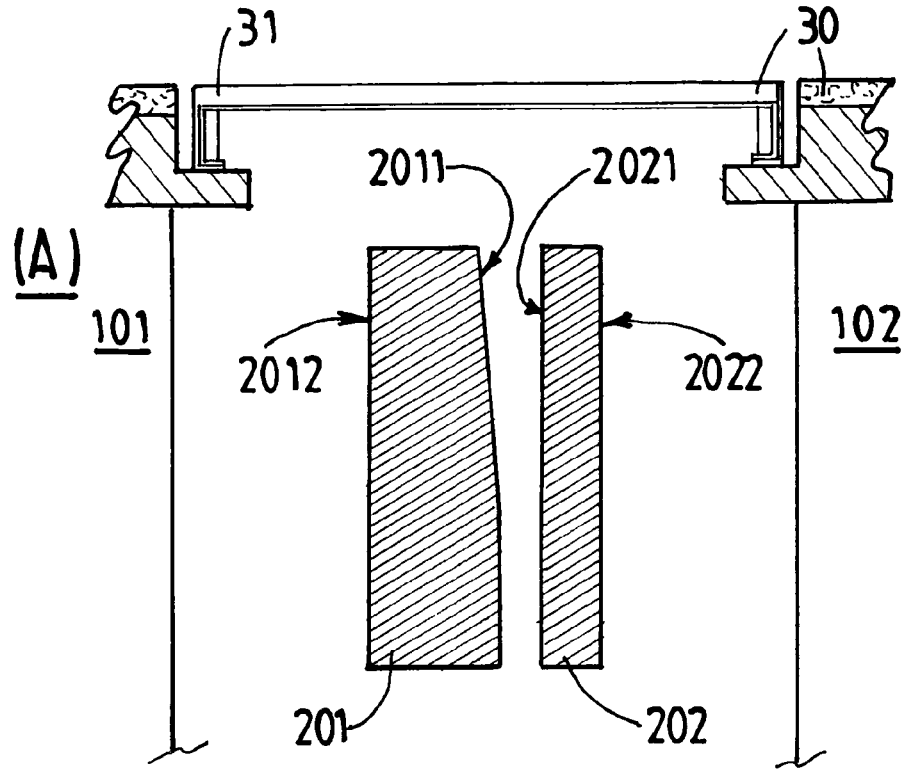
FIG. 3 illustrates, in a simplified manner, two conductor portions of an arrangement of conductors in a row of electrolysis cells with and without a short-circuit.
Figure 3:
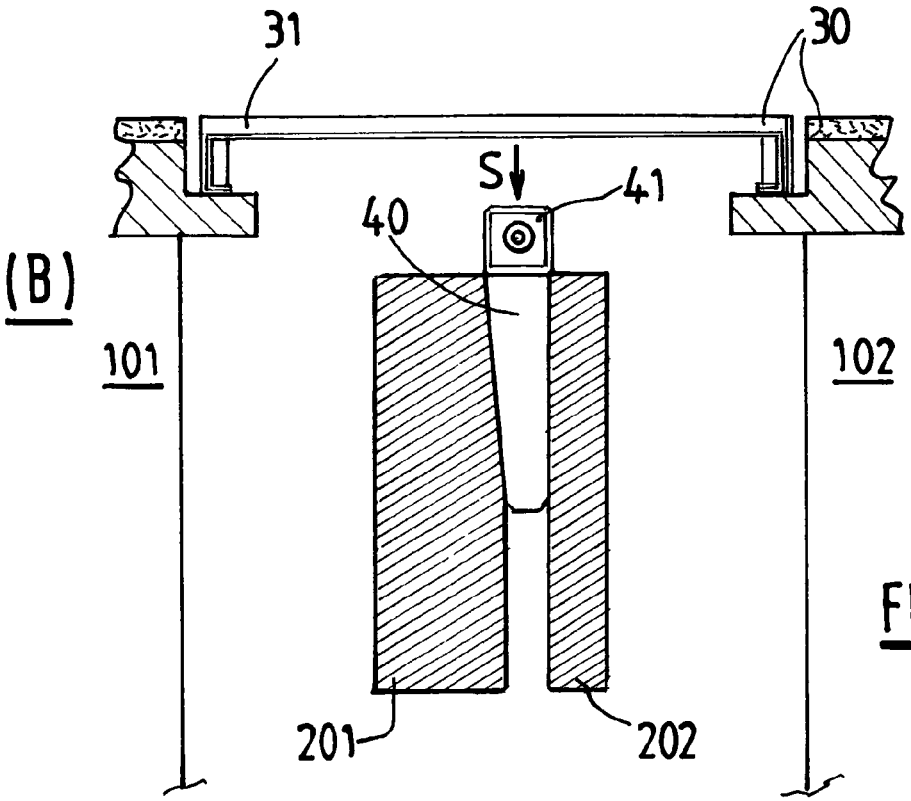

More specifically, as illustrated in FIG. 3 (A), said conductor network (20) includes at least a first conductor portion (201) that is electrically connected to an anode beam of a cell to be short-circuited (102) and at least a second conductor portion (202) that is electrically connected to a collector bar of said cell to be short-circuited (102). The electrical connection between said first conductor portion (201) and said anode beam may be direct or indirect, i.e. there may or may not be other conductor portions (such as flexible conductors or risers) interposed between said first conductor portion (201) and said anode beam. The electrical connection between said second conductor portion (202) and said collector bar may also be direct or indirect, i.e. there may or may not be other conductor portions (such as flexible conductors or busbars) interposed between said second conductor portion (202) and said collector bar.

Said first and second conductor portions (201, 202) are illustrated in cross-section in FIGS. 3 to 7.

Said first conductor portion (201) has a first internal surface (2011) and a first external surface (2012), which is substantially opposite said first internal surface (2011). Said second conductor portion (202) has a second internal surface (2021) and a second external surface (2022) that is substantially opposite said second internal surface (2021). Said first conductor portion (201) and said second conductor portion (202) are usually so arranged that said first internal surface (2011) substantially faces said second internal surface (2021). Said first and second conductor portions (201, 202) are preferably substantially parallel to each other.

Said internal surfaces (2011, 2021) and said external surfaces (2012, 2022) may be vertical or inclined with respect to a vertical line.

FIG. 3 illustrates a typical arrangement in which said first conductor portion (201) and said second conductor portion (202) are located underneath a common floor (30) and between the pot of a first cell (101) and the pot of a second cell (102). This arrangement is usual for the plants in which the electrolysis cells are arranged transversally in a row.

As illustrated in FIG. 3(B), short-circuiting is typically done by inserting one or more metallic blocks (40) between said first and second conductor portions (201, 202) in a location where these conductors are close to one another. Said metallic blocks (40) generally have the form of a wedge and conveniently include a grabbing means (41), such as a handle or a hook, for removing the same when the short-circuit needs to be opened. Arrow S in FIG. 3(B) indicates the direction of insertion of said blocks (40).

At least one short-circuiting device according to the invention is advantageously used to achieve said short-circuiting of an electrolysis cell in an arrangement of cells. Said device can be used alone or in combination with one or more short-circuiting means, such as said metallic blocks (40).

Figure 4:
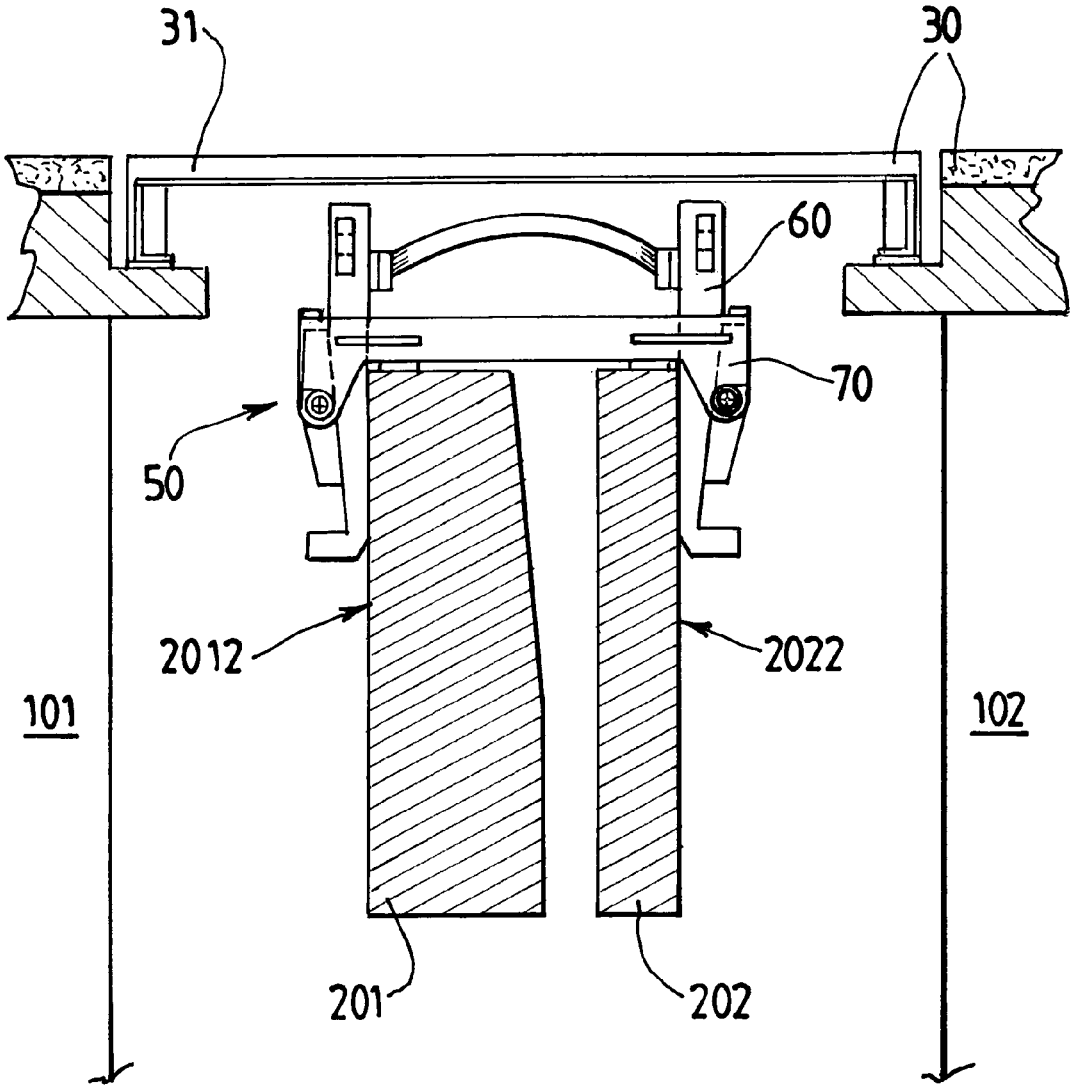
FIG. 4 illustrates a short-circuit between two conductor portions using a short-circuiting device according to an embodiment of the invention.

FIG. 4 illustrates a preferred embodiment of a short-circuiting device (50) according to the invention. In this drawing, said short-circuiting device (50) is placed on said first and second conductor portions (201, 202) so as to short-circuit said conductor portions.

Figure 5:
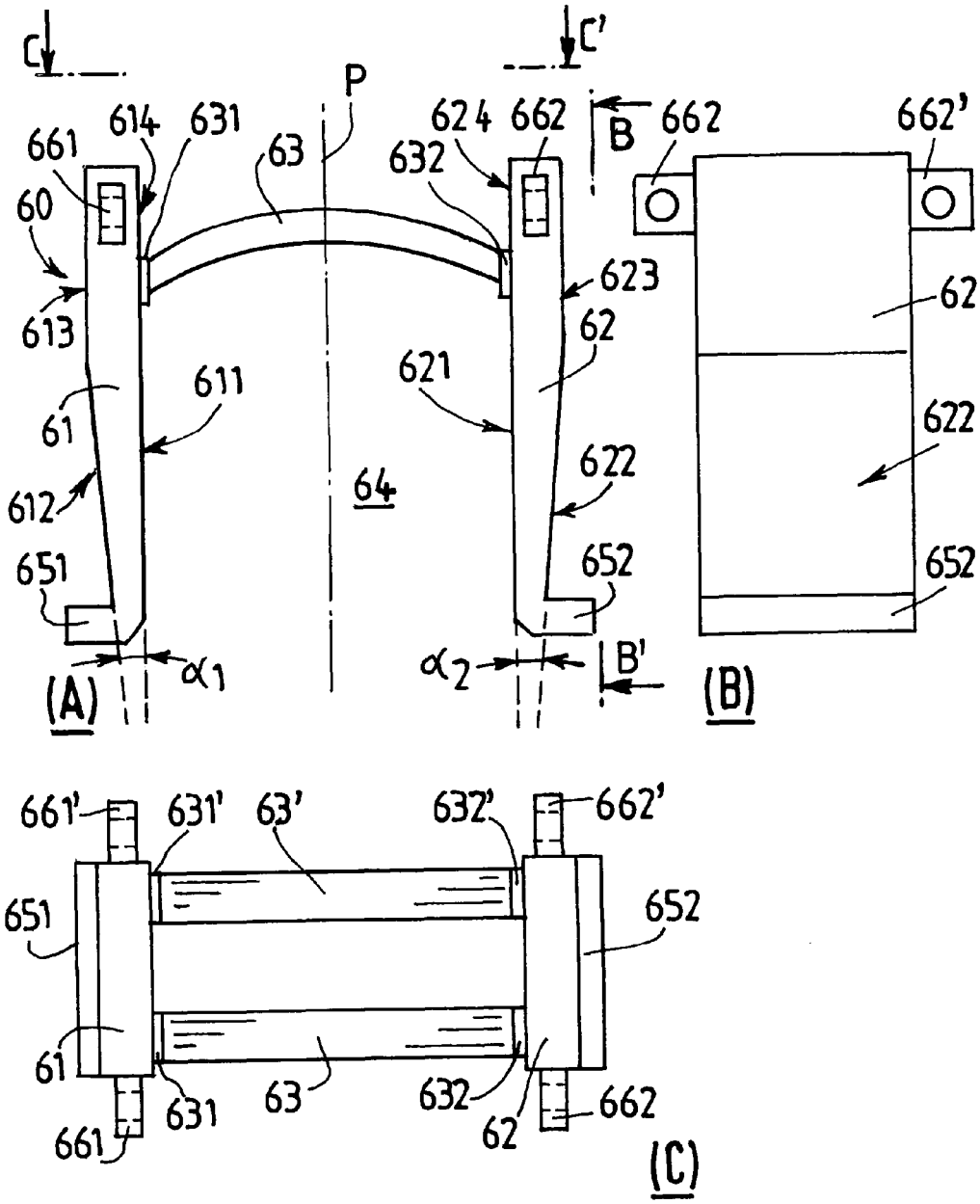
FIG. 5 illustrates a bridging member according to an embodiment of the invention.
Figure 6:
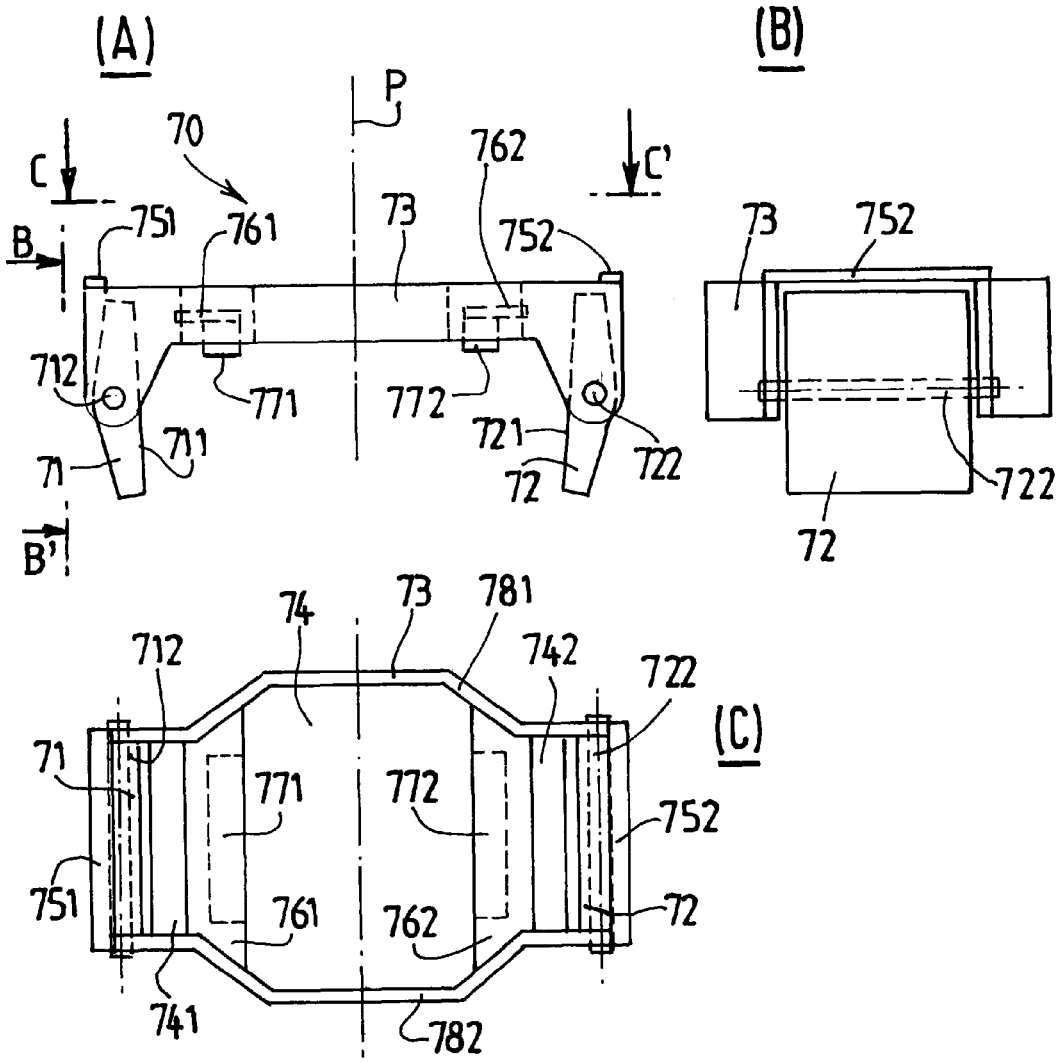
FIG. 6 illustrates a clasping member according to an embodiment of the invention.

As illustrated in FIG. 4, said device (50) includes, in combination, a bridging member (60) and a clasping member (70). FIG. 5 illustrates a preferred embodiment of said bridging member (60) while FIG. 6 illustrates a preferred embodiment of said clasping member (70). In both FIGS. 5 and 6, part (A) is a side view, part (B) is another side view corresponding to a view in plane B-B' of part (A) and part (C) is a top view corresponding to a view in plane C-C' of part (A).

As illustrated in FIG. 5, said bridging member (60) includes at least a first contact arm (61), at least a second contact arm (62) and at least one bridging conductor (63, 63') that electrically connects said first and second contact arms (61, 62) together. Said first contact arm (61) has a first contact surface (611) and a first outer surface (612) that is substantially opposite said first contact surface (611) and inclined with respect to the same. Said second contact arm (62) has a second contact surface (621) and a second outer surface (622) that is substantially opposite said second contact surface (621) and inclined with respect to the same. In other words, each of said arms (61, 62) is at least partly tapered like a wedge.

Said bridging member (60) forms an opening (64) (typically a bight) between said contact arms (61, 62), which is shaped somewhat like a U. Said opening (64) has specific dimensions, especially a specific spacing between said contact arms (61, 62). Said opening (64) is preferably sufficiently wide to overlap said first and second conductor portions (201, 202) as illustrated in FIG. 4 and provide an electrical contact between said first arm (61) and said first external surface (2012) as well as between said between said second arm (62) and said second external surface (2022). In other words, the dimensions of said bridging member (60) are such that said first and second conductor portions (201, 202) can fit in said opening (64) so that said first contact surface (611) can overlap said first external surface (2012) (and push on the same when pressure is applied) while said second contact surface (621) can overlap said second external surface (2022) (and push on the same when pressure is applied), thereby enabling the formation of a short-circuit between said first and second conductor portions (201, 202).

Said contact arms (61, 62) are metallic parts that function as electrical contact shoes and enable electrical current to flow from said contact surfaces (611, 621) to said bridging conductor (63, 63'). For that purpose, said contact surfaces (611, 621) are preferably substantially flat, in order to spread the current over an extended surface contact area, and may advantageously be rough or include projections, in order to reduce electrical contact resistance.

Said contact arms (61, 62) are preferably made of a ferrous metal, such as steel, so as to simultaneously provide sufficient electrical conduction and sufficient mechanical strength. Said contact arms (61, 62) may be coated with a layer of conducting material so as to reduce contact resistance.

Said bridging conductor (63, 63') is preferably made of aluminium, aluminium alloy, copper, copper alloy, or any combination thereof, so as to provide sufficient electrical conduction and mechanical flexibility while limiting mass and volume. Said bridging conductor (63, 63') is preferably made of foils or a plurality of conductors to further increase the mechanical flexibility thereof.

Said contact arms (61, 62) are typically substantially parallel, although the softness of said bridging conductor (63, 63') enables sensible deviations from parallelism, which makes it possible to fit said bridging member (60) on various orientations of said external surfaces (2012, 2022) of said conductor portions (201, 202).

FIGS. 4 to 7 illustrate an embodiment wherein each contact arm (61, 62) includes an upper external surface (613, 623) that is substantially parallel to said contact surfaces (611, 621) and inclined with respect to said outer surfaces (612, 622). However, the invention encompasses other possible embodiments provided that said contact surfaces (611, 621) are inclined with respect to said outer surfaces (612, 622). For example, said upper external surfaces (613, 623) may be parallel to said outer surfaces (612, 622) while each contact arm (61, 62) includes an upper inner surface (614, 624) that is substantially parallel to said outer surfaces (612, 622) and inclined with respect to said contact surfaces (611, 621). Such variations may be more suitable when said external surfaces (2012, 2022) are inclined with respect to a vertical line.

Said outer surfaces (612, 622) may be concave, convex, flat or any other shape. In order to make the pressing action of said thrust members (71, 72), said outer surfaces (612, 622) are preferably substantially flat. More precisely, in this embodiment of the invention, as illustrated in FIG. 5, said first outer surface (612) is substantially flat and inclined by an angle $\alpha_1$ with respect to said first contact surface (611) while said second outer surface (622) is substantially flat and inclined by an angle $\alpha_2$ with respect to said second contact surface (621). Said angles $\alpha_1$ and $\alpha_2$ are typically between 1° and 20° and preferably between 3° and 10°. Said angles $\alpha_1$ and $\alpha_2$ are preferably equal so as to ease the supply of said contact arms (61, 62) and make them interchangeable.

The dimensions of said contact arms (61, 62) are typical such that a current density below a specified value is obtained on the area of electrical contact between said contact arms (61, 62) and said first and second conductor portions (201, 202).

Said bridging member (60) is typically symmetrical with respect to a central plane P, although asymmetrical arrangements are also within the scope of the invention.

Said bridging conductor (63, 63') may be secured to said contact arms (61, 62) using bi-metallic connection members (631, 631', 632, 632') interposed between said bridging conductor (63, 63') and said arms (61, 62). For example, a copper bridging conductor (63, 63') may be secured to a steel arm (61, 62) using a copper-steel bi-metallic connector welded to these parts.

Each of said contact arms (61, 62) advantageously includes at least one projection (651, 652) that projects away from said opening (64) and acts as an abutment for said clasping member (70). Said projections (651, 652) make it possible to withdraw said short-circuiting device (50) by pulling on said bridging member (60) only, said clasping member (70) then being pulled up and dragged along by said projections (651, 652).

Each of said contact arms (61, 62) advantageously further includes at least one grabbing means (661, 661', 662, 662') such as a handle or a hook.

As illustrated in FIG. 6, said clasping member (70) includes a frame (73), a first thrust member (71) and a second thrust member (72). Said frame (73) and thrust members (71, 72) are typically made of a ferrous metal, such as steel, so as to provide sufficient mechanical strength.

Said frame (73) typically includes at least one aperture (74, 741, 742) for engaging said contact arms (61, 62) thereinto. As illustrated in FIG. 6, said frame (73) typically includes at least two cross members (781, 782), which are spaced apart and designed to overlap said conductor portions (201, 202) in use, and transverse members (751, 752) that are secured to said cross members. Said aperture (74, 741, 742) is typically between said cross members (781, 782). Said frame (73) may include strengthening parts such as transverse pieces (761, 762), which are typically made of ferrous metal, such as steel. Said strengthening parts may form apertures (741, 742) for inserting said contact arms (61, 62) therein.

Said clasping member (70) is fit to embrace said bridging member (60) so that said first outer surface (612) can bear on said first thrust member (71) while said second outer surface (622) can bear on said second thrust member (72), typically in a sliding relationship, and so that, upon moving said contact arms (61, 62) with respect to said clasping member (70) (and more precisely with respect to said thrust members (71, 72)), said first thrust member (71) urges (i.e., exerts a force on) said first outer surface (612) (and thus on said first contact arm (61)) towards said second contact arm (62) (and thus towards said first conductor portion (201)) while said second thrust member (72) urges (i.e., exerts a force on) said second outer surface (622) (and thus on said second contact arm (62)) towards said first contact arm (61) (and thus towards said second conductor portion (202)), thereby creating and securing a short-circuit between said conductor portions (201, 202).

Said thrust members (71, 72) may be integral with said frame (73).

Said first thrust member (71) and said second thrust member (72) are preferably fitted on a first axle (712) and a second axle (722), respectively. Advantageously, said first thrust member (71) includes a first bearing surface (711) while said second thrust member (72) includes a second bearing surface (721). Said first and second axles (712, 722) are preferably substantially parallel to said first and second bearing surfaces (711, 721), respectively. These variations of the invention enable the pivoting of said thrust members (71, 72) and a self-adjustment of the inclination of said first and second bearing surfaces (711, 721) to the actual inclination of said outer surfaces (612, 622) of said contact arms (61, 62) in use.

Said frame (73) may further include support members (771, 772), such as feet or pads, that are fit to lie on said conductor portions (201, 202) and act as stoppers in use.

Said bridging member (60) and said clasping member (70) are typically separate members. However, once assembled to form a short-circuiting device (50), said members are typically handled as a single unit.

The invention further relates to a method of short-circuiting at least one specified electrolysis cell in an arrangement of cells intended for the production of aluminium by igneous electrolysis. Said method includes placing at least one short-circuiting device (50) according to the invention so that said first and second conductor portions (201, 202) fit in said opening (64) of said bridging member (60) and so that said first contact surface (611) overlaps said first external surface (2012) while said second contact surface (621) overlaps said second external surface (2022).

Said method further includes moving said contact arms (61, 62) of said bridging member (60) relative to said clasping member (70) so that said first thrust member (71) urges said first contact arm (61) towards said second contact arm (62)—and thus towards said first conductor portion (201)—while said second thrust member (72) urges said second contact arm (62) towards said first contact arm (61)—and thus towards said second conductor portion (202)—, thereby creating and securing a short-circuit between said first and second conductor portions (201, 202). Said moving is typically obtained by knocking or hammering from above on the top of said contact arms (61, 62).

A short-circuiting device (50) according to the invention can advantageously be used in combination with one or more metallic blocks (40) to short-circuit a cell. Thus, the method according to the invention advantageously further includes inserting at least one metallic block (40)—typically a metallic wedge—between said first and second conductor portions (210, 202), advantageously at least partly between said arms (61, 62). The electrical current then circulates in said device (50) and said block or blocks (40). Since the current load in said device (50) is significantly reduced, it is possible to use a device with smaller dimensions.

Figure 7:
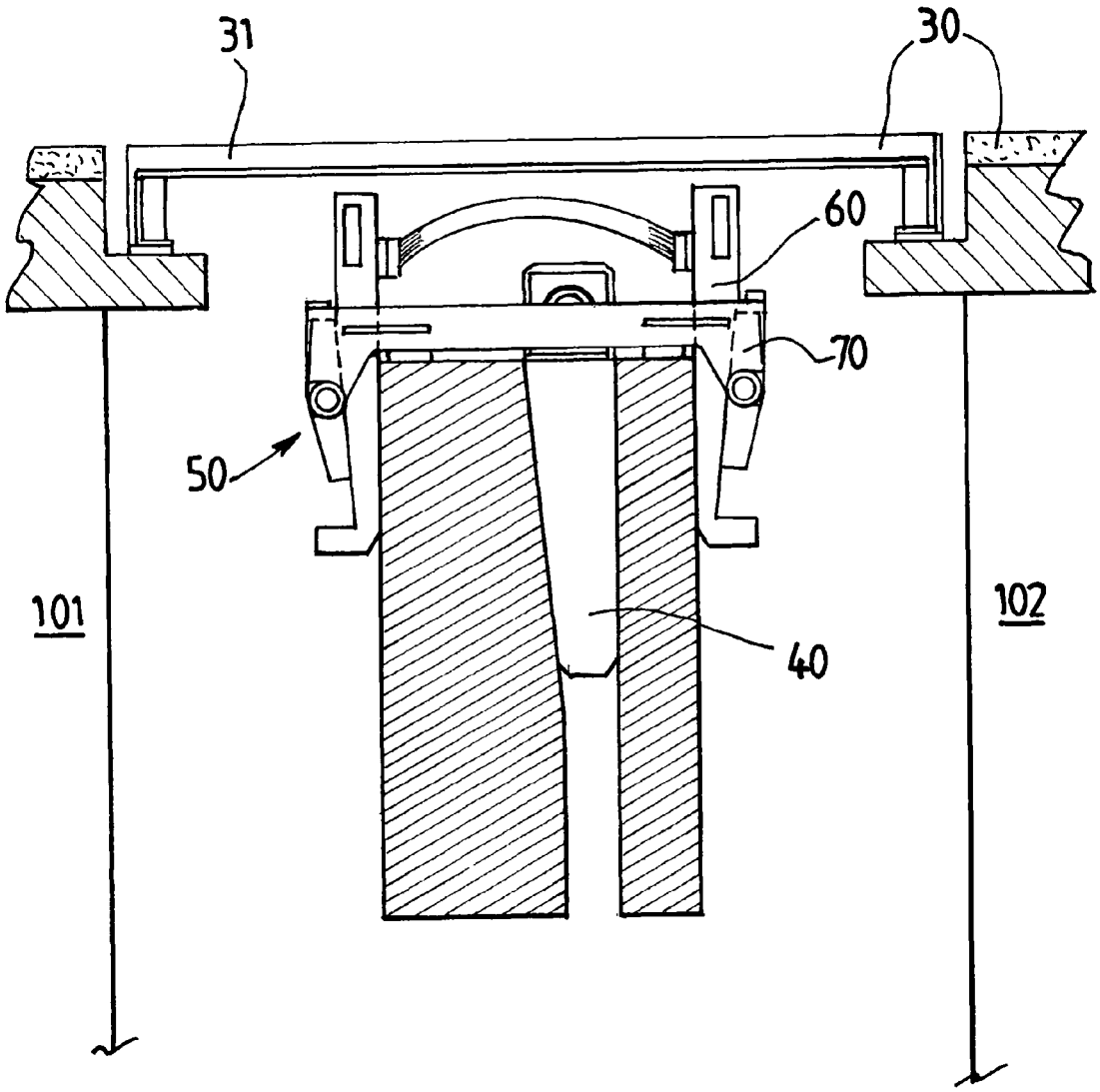
FIG. 7 illustrates a short-circuit arrangement between two conductor portions according to an advantageous variation of the invention.

FIG. 7 illustrates a preferred embodiment of these variations of the invention. In this embodiment, at least one metallic block (40) is inserted between said first and second conductor portions (210, 202) and between said arms (61, 62). This embodiment further improves the stability of the electrical contacts between said conductor portions (201, 202) and said contact arms (61, 62) by limiting the deformation, and especially the sagging, of said conductor portions (201, 202). The top part of said metallic block (40) can be accessible from the top of said short-circuiting device (50), so as to enable its further insertion by knocking or hammering from above said device. Said metallic block (40) may optionally be fixed to said short-circuiting device (50).

Such variations of the invention are especially useful for existing plants in which the intensity of the cells have been significantly increased compared to their initially intended intensity; a device according to the invention is then used to alleviate the current loads on the metallic blocks (40) that are normally used.

Said short-circuiting device (50) can be removed by pulling, preferably by pulling said grabbing means (661, 661', 662, 662').

The short-circuiting operations are advantageously done by operators located on said floor (30), typically after temporarily removing one or more slabs (31). Said short-circuiting device (50) may be handled using a crane or a pot tending machine.

NUMERAL REFERENCES

1 Electrolysis cell
100 Arrangement of electrolysis cells
101, 102, 103 Electrolysis cells
2 Pot
3 Shell
4, 4' Refractory lining material
5 Cathode arrangement
6 Collector bar
7 Electrolytic bath
8 Pad of liquid aluminium
9 Protecting layer
10, 10' Anodes
11, 11' Anode stems
12, 12' Anode beams
20 Network of interconnecting conductors
21, 22, 23, 24, 25, 26 Interconnecting conductors
201 First conductor portion
202 Second conductor portion
211, 212, 221, 222 Branches
2011 First internal surface
2012 First external surface
2021 Second internal surface
2022 Second external surface
30 Floor
31 Slab
40 Metallic block
41 Grabbing means
50 Short-circuiting device
60 Bridging member
61 First contact arm
611 First contact surface
612 First outer surface
613 Upper external surface
614 Upper inner surface
62 Second contact arm
621 Second contact surface
622 Second outer surface
623 Upper external surface
624 Upper inner surface
63, 63' Bridging conductors
631, 632, 631', 632' Bi-metallic connection members
64 Opening
651, 652 Projections
661, 661', 662, 662' Grabbing means
70 Clasping member
71 First thrust member
711 First bearing surface
712 First axle
72 Second thrust member
721 Second bearing surface
722 Second axle
73 Frame
74, 741, 742 Apertures
751, 752 Transverse members
761, 762 Transverse pieces
771, 772 Support members
781, 782 Cross members

The invention claimed is:

1. Device for short-circuiting at least one specified cell in an arrangement of electrolysis cells intended for the production of aluminium by igneous electrolysis, said arrangement including a plurality of electrolysis cells that are electrically connected in series, wherein said device includes:

a bridging member including a first contact arm having a first contact surface and a first outer surface, a second contact arm having a second contact surface and a second outer surface, and at least one bridging conductor that electrically connects said first and second contact arms, said first contact surface being substantially opposite and inclined with respect to said first outer surface, said second contact surface being substantially opposite and inclined with respect to said second outer surface, said bridging member forming an opening between said contact arms, and a clasping member including a frame, a first thrust member and a second thrust member, said clasping member being fit to embrace said bridging member so that said first outer surface bears on said first thrust member while said second outer surface bears on said second thrust member and so that, upon moving said first and second contact arms with respect to said clasping member, said first thrust member urges said first contact arm towards said second contact arm while said second thrust member urges said second contact arm towards said first contact arm.

2. Short-circuiting device according to claim 1, wherein said first and second contact surfaces are substantially flat.

3. Short-circuiting device according to claim 1, wherein said first and second contact surfaces are rough or include projections.

4. Short-circuiting device according to claim 1, wherein said first and second contact arms are made of a ferrous metal.

5. Short-circuiting device according to claim 1, wherein said at least one bridging conductor is made of aluminium, aluminium alloy, copper, or copper alloy, or any combination thereof.

6. Short-circuiting device according to claim 1, wherein said at least one bridging conductor is made of foils or a plurality of conductors.

7. Short-circuiting device according to claim 1, wherein said first outer surface is substantially flat and inclined by an angle $\alpha_1$ with respect to said first contact surface and wherein said second outer surface is substantially flat and inclined by an angle $\alpha_2$ with respect to said second contact surface.

8. Short-circuiting device according to claim 7, wherein said angles $\alpha_1$ and $\alpha_2$ are between 1° and 20°.

9. Short-circuiting device according to claim 7, wherein said angles $\alpha_1$ and $\alpha_2$ are equal.

10. Short-circuiting device according to claim 1, wherein each of said first and second contact arms includes at least one projection that projects away from said opening and acts as an abutment for said clasping member.

11. Short-circuiting device according to claim 1, wherein each of said first and second contact arms further includes at least one grabbing means.

12. Short-circuiting device according to claim 1, wherein said frame and said first and second thrust members are made of a ferrous metal.

13. Short-circuiting device according to claim 1, wherein said frame includes at least one aperture for engaging said first and second contact arms thereinto.

14. Short-circuiting device according to claim 1, wherein said first thrust member is fitted on a first axle and wherein said second thrust member is fitted on a second axle.

15. Short-circuiting device according to claim 14, wherein said first thrust member includes a first bearing surface while said second thrust member includes a second bearing surface and wherein said first and second axles are substantially parallel to said first and second bearing surfaces, respectively.

16. Method of short-circuiting at least one specified cell in an arrangement of electrolysis cells intended for the production of aluminium by igneous electrolysis, said arrangement including a plurality of electrolysis cells, and a network of electrical conductors, said specified cell including a pot and at least one anode beam for connecting at least one anode thereto, said pot including a cathode arrangement and at least one collector bar connected to said cathode arrangement and protruding from said pot, said network including at least a first conductor portion that is electrically connected to said at least one anode beam and has a first internal surface and a first external surface substantially opposite said first internal surface, and at least a second conductor portion that is electrically connected to said at least one collector bar and has a second internal surface and a second external surface substantially opposite said second internal surface, said first and second conductor portions being so arranged that said first internal surface substantially faces said second internal surface, wherein said method includes:

providing at least one short-circuiting device according to claim 1, placing said device so that said first and second conductor portions fit in said opening and so that said first contact surface overlaps said first external surface while said second contact surface overlaps said second external surface, and moving said first and second contact arms of said bridging member relative to said clasping member so that said first thrust member urges said first contact arm towards said second contact arm while said second thrust member urges said second contact arm towards said first contact arm, thereby creating and securing a short-circuit between said first and second conductor portions.

17. Short-circuiting method according to claim 16, wherein said method further includes inserting at least one metallic block between said first and second conductor portions.

18. Short-circuiting method according to claim 17, wherein said at least one metallic block is disposed at least partly between said arms.

* * * * *